United States Patent [19]

Horiuchi

[11] 4,401,317

[45] Aug. 30, 1983

[54] SKI BINDING

[76] Inventor: Yasushi Horiuchi, 11-8 Kamiyoga 3-chome, Setagaya-ku, Tokyo, Japan

[21] Appl. No.: 270,014

[22] Filed: Jun. 3, 1981

[30] Foreign Application Priority Data

Jun. 19, 1980 [JP] Japan ..... 55-083116

[51] Int. Cl.[3] ..... A63C 9/08

[52] U.S. Cl. ..... 280/625; 280/628

[58] Field of Search ..... 280/611, 612, 623, 624, 280/625, 626, 631, 632, 634

[56] References Cited

U.S. PATENT DOCUMENTS

| | | | |
|---|---|---|---|
| 3,329,438 | 7/1967 | Lusser | 280/625 |
| 3,692,322 | 9/1972 | Marker | 280/629 |
| 3,947,051 | 3/1976 | Sittmann | 280/612 |
| 3,966,218 | 6/1976 | Beyl | 280/631 |
| 4,156,534 | 5/1979 | Salomon | 280/612 |

FOREIGN PATENT DOCUMENTS

| | | |
|---|---|---|
| 20373 | 3/1958 | Fed. Rep. of Germany . |
| 1959821 | 11/1969 | Fed. Rep. of Germany . |
| 2324776 | 5/1973 | Fed. Rep. of Germany . |
| 2109799 | 9/1971 | France . |
| 2300587 | 2/1975 | France . |
| 482449 | 11/1968 | Switzerland . |
| 492462 | 6/1969 | Switzerland . |

*Primary Examiner*—David M. Mitchell

*Assistant Examiner*—Joseph G. McCarthy

*Attorney, Agent, or Firm*—Parkhurst & Oliff

[57] ABSTRACT

A ski binding, either a toe clamp or a heel clamp, which is provided with clamping arm rotatably supported by a post fitted on the top surface of a ski, the post having a pendulum to face a hungover end of the clamping arm which is urged toward the boot by a mild elastic member. A marginal clearance is provided between the end of the pendulum and the hungover end of the clamping arm, whereby the clamping arm is locked by the pendulum and keeps clamping the boot onto the ski under normal use of the skis, but the clamping arm is not locked by the pendulum and allows the ski boot to be readily disengaged from the ski under an abnormal condition, such as fall, which causes the pendulum to be out of the lock position. A modification of this generic configuration is possible, which gives elasticity to the clamping arm by means of a second, stronger elastic member. Use of plural pieces of the generic or modified clamping unit improves the function and provides a variety in performance. Joint employment of a toe clamp and a heel clamp is effective to further improve the function. Employment of the clamp in combination with a pivot pin arranged on a ski so as to engage a recess provided in the sole of a ski boot allows the best control and safety in any event including fall and application of a lateral shock to the front side of a ski.

40 Claims, 11 Drawing Figures

SKI BINDING

TECHNICAL FIELD

This invention relates to a ski binding, more specifically to a heel clamp which is employed to clamp the heel of a ski boot with a ski under joint employment of a toe clamp which can be selected from those which are available in the prior art, to a toe clamp which is employed to clamp the toe of a ski boot with a ski under joint employment of a heel clamp which can be selected from what are available in the prior art or from the heel clamps in accordance with this invention, or to a combination of a heel clamp in accordance with this invention, a toe clamp in accordance with this invention and a pivot pin arranged on the top surface of a ski to be engaged with a recess provided in the sole of a ski boot. More specifically, this invention relates to an improvement applicable to a ski binding for the purpose to increase the safety of a skier particularly of a beginner in the event that the skier falls with a less magnitude of speed than that which is required to release an ordinary ski binding available in the prior art.

BACKGROUND OF THE INVENTION

The essential functions of a ski binding are to firmly maintain a ski boot in place on a ski during the normal use of skis and to disengage a ski boot from a ski, whenever a user has bumped against something or fallen down in any manner specifically in any direction at any speed and the like. The former function is required to allow a user to control skis under his desire, and the latter function is required to protect him against injury, such as fracture, sprain, dislocation and the like.

To satisfy these two conflicting independent requirements, the ski bindings in the prior art are designed to elastically clamp the toe and the heel of a ski boot with a ski. More specifically, the toe clamp is provided with an upper clamping member which clamps the front top edge of a ski boot downward, and a pair of side clamping members or jaws each of which elastically clamps the corresponding front side edge of a ski boot inwardly in the horizontal direction and disengages the same, whenever the front side edge of a ski is urged sideways with an amount of energy sufficient to displace the corresponding side clamping member or jaw outwardly beyond a predetermined amount of length or angle. The heel clamp is provided with a vertical clamping member which elastically clamps the rear top edge of a ski boot downward in the vertical direction and disengages the same, whenever the rear top edge of a ski is urged upward with an amount of energy sufficient to upwardly displace the corresponding vertical clamping member beyond a predetermined amount of height or angle. The heel clamp is sometimes provided also with a pair of side clamping members each of which elastically clamps the corresponding rear side edge of a ski boot inwardly in the horizontal direction and disengages the same, whenever the rear side edge of a ski is urged sideways with an amount of energy sufficient to outwardly displace the corresponding side clamping member beyond a predetermined amount of length or angle. It is clear, therefore, that the function of a ski binding available in the prior art inevitably depends on the displacement of or the energy absorbed in one or more elastic members employed for the ski binding.

In order to control skis or change the sliding direction of skis, a torque which is usually called "Fersen Schub" (heel thrust) in Germany is required. This heel thrust must be applied to a point of ski which is located apart from the point where the combined snow resistance is applied to a ski, which is located around the center of the entire length of a ski contacting the surface of snow but which moves back and forth depending on the snow conditions and the like. Incidentally, the point at which this heel thrust is applied moves depending on the forward inclination of a user but is approximately located slightly ahead of the heel. The distance between the point where the combined snow resistance is applied to a ski and the point where the heel thrust is applied to the ski is the length of arm which determines the amount of the torque. On the other hand, since the heel thrust is applied to a ski through the point which connects the ski boot and the ski, the heel thrust of course functions to disengage the toe clamp and/or the heel clamp.

Therefore, it is clear that such a ski binding as depends on the displacement of one or more elastic members is involved with adverse effects for controlling skis, because a powerful control of skis frequently results in unexpected disengagement of a ski boot from a ski. Therefore, a tendency is observed to set the tension of the elastic toe and/or heel clamping members, such as springs, as large as possible for the purposes to reduce the displacement of the elastic members and to reduce possibilities of unexpected disengagement of a ski boot from a ski. As a result, the heel vertical clamping member is inclined to be set not to disengage a ski boot from a ski, unless a force as high as 50 through 200 Kg is applied between the heel and the heel vertical clamping member to cause a displacement in the magnitude of 10 through 20 mm for the heel. The corresponding figure for the heel horizontal clamping member or the toe horizontal clamping member is 20 through 80 Kg. These figures are extremely high from the view point of safety, because some parts of the human body can not endure even 5 Kg. This tendency can be a parameter causing injury such as fracture, sprain, dislocation and the like for any body including experts and beginners.

Incidentally, however, it is true that any of the conventional ski binding of which the function predominantly depends on the displacement of elastic members sufficiently functions or safely disengages a ski boot from a ski, if some or all of the elastic members are urged with the sufficient amount of energy to cause a predetermined magnitude of displacement for the corresponding elastic members, without giving an abnormally large amount of force to any part of the user's body. This means that any of the conventional ski binding functions well, whenever a user has bumped against something or fallen with a speed in excess of a predetermined amount which is involved with a predetermined amount of kinetic energy enough to cause some of the clamps to function. However, whenever a user has bumped against something in a strange manner or fallen at a relatively small speed which corresponds to an amount of kinetic energy less than that which is enough to cause one of the clamps to function, there is a large possibility that the ski binding does not disengage a ski boot from a ski. Mostly in such a case, despite the fact that the user has a marginal amount of kinetic energy due to his speed, an injury occurs, because he has a considerable amount of potential energy which is equivalent to the kinetic energy involved with the speed in excess of 10 Km/hour and which is enough to cause injury to some part of his body, depending on the manner in which the energy is applied to the specific part of his body.

Accordingly, it has been determined that the ski binding available in the prior art and which utilizes one or more elastic members can safely disengage a ski boot from a ski, in the event that a user particularly an expert has fallen at a relatively high speed. However, the conventional ski binding has a tendency not to disengage a ski boot from a ski in the event that a user, particularly a beginner, has fallen at a slow speed, potentially causing injury depending on the manner of his fall. Therefore, albeit the ski binding in the prior art may be safe for experts, it is not necessarily safe for beginners.

On the other hand, most of the heel clamps in the prior art have a shape to partly surround a heel in order to firmly clamp the heel. As a result, such heel clamps are scarcely allowed to move sideways, and such ski bindings disengge a ski boot from a ski only in the case where the toe is rotated beyond a predetermined amount of angle centering around the heel as the pivot. For example, when a user tries to change the sliding direction of skis, he applied a heel thrust (Fersen Schub) to the skis from left to right with his heel, and the combined snow resistance is applied to the center of the entire length of a ski contacting the surface of snow, from right to left. Therefore, these two forces function to displace the right toe clamping member. If, at this time, a shock is applied at the front end of a ski from right to left, this shock functions in the same direction as the above mentioned two forces, resultantly causing the right toe clamping member to quite easily disengage the ski boot from a ski, despite the fact that the user does not to intend or desire. Therefore, a stronger tension is required for toe clamping members to reduce the possibilities of this type of unintentional disengagement of a ski boot from a ski. This of course causes an adverse effect for safety. In other words, if a sufficient magnitude of safety is required, sufficient magnitude of control can not be obtained, and if a sufficient magnitude of control is required, a sufficient magnitude of safety can not be obtained.

OBJECTS AND SUMMARY OF THE INVENTION

An object of this invention is to provide a ski binding, specifically a heel clamp or a toe clamp which firmly clamps a ski boot with a ski under a normal use of skis to allow the best control of skis for the user and which readily disengages a ski boot from a ski in an abnormal incident such as the user's fall and the like, regardless of the speed at which he has fallen.

Anothet object of this invention is to provide a ski binding, specifically a heel clamp or a toe clamp, which is improved in safety particularly in the event that a user has fallen precisely forward or backward.

A further object of this invention is to provide a ski binding, specifically a heel clamp or a toe clamp, which is improved in safety, particularly on the event that a user has fallen sideways.

An additional object of this invention is to provide a ski binding which is further improved in function against a shock applied to the front side end of a ski, thereby providing the maximum control and safety for all cases.

A heel clamp or a toe clamp in accordance with this invention comprises a heel or toe clamping arm which hangs over and which is rotatably supported by a post fitted on the top surface of a ski, an elastic member which urges the heel or toe clamping arm downward for the purpose to clamp the heel or toe of a ski boot with a ski with a force of 5 Kg or so, and a pendulum which is arranged to be allowed to swing beneath the hungover end of the heel or toe clamping arm under a condition that a clearance is kept between the top end of the pendulum and the lower surface of the heel or toe clamping arm, whereby the heel or toe of a ski boot is clamped with a skis, because the hungover end of the heel or toe clamping arm is locked by the top end of the pendulum under a normal use of skis, but the heel or toe of a boot is disengaged from a ski, as soon as the pendulum inclines with respect to the ski at a relatively slow speed, more specifically the direction of pendulum deviates from the direction perpendicular to the top surface of a ski at a relativelly slow speed. As a result, this heel clamp or toe clamp in accordance with this invention allows the maximum control of skis for the user under the normal use of skis and prevents any injury from occurring particularly for beginners who are inclined to fall aside at a relatively slow speed which is involved with the kinetic energy which is not enough to allow a ski binding available in the prior art to function. Arrangement of the elastic member allows various modifications. Specifically, the elastic member, mostly a spring, could be a compressed compression spring arranged between the post and the top surface of the heel or toe clamping arm or between the under surface of the hungover end of the heel or toe clamping arm and the top surface of a ski, or could be an expanded expansion spring arranged between the udner surface of the heel or toe clamping arm and the top surface of a ski or between the top surface of the hungover end of the heel or toe clamping arm and the post. Further, the spring could be a leaf spring one end of which is fitted on the top surface of a ski. Any type of toe clamps or heel clamps available in the prior art is acceptable to be employed in combination respectively with this heel clamp or toe clamp in accordance with this invention. It is of course possible to employ this heel clamp in accordance with this invention with this toe clamp in accordance with this invention. It is of course preferable that a means for adjusting the location of the post back and forth and a cover protecting the heel or toe clamp from snow and/or ice are provided. It would be clear, however, these are included in the category of design preference.

Further, a heel clamp or a toe clamp is available which is provided with plural clamping units each of which consists of a heel or toe clamping arm, an elastic member which urges the heel or toe clamping arm toward a ski boot and an end or a projection of a pendulum commonly employed for all the units, the end or projection of the pendulum being employed to lock or unlock the heel or toe clamping arm. Particularly, a heel clamp or a toe clamp provided with three clamping units, one of which is employed in the vertical direction and the others of which are employed in the horizontal direction, is realistic.

It may be evident that since this generic ski bindings in accordance with this invention is provided with the maximum control as well as the necessary magnitude of safety, they are appropriate for experts rather than beginners.

The above mentioned generic structures are involved with some potential drawbacks due to lack of flexibility. Firstly, if a user has fallen precisely forward or backward and the pendulum is not allowed to swing, the heel and/or toe clamping arm is locked with an extremely large amount of force, doubtless causing injury for the user. In the case where the number of the clamping units is one, the end of the heel or toe clamping arm is desired to have a shape partly surrounding the heel or toe respectively. This preference increasees the possibility of the above mentioned danger. Secondly, if a user has fallen in any direction during the period in which the heel and/or toe clamping arm is locked by some chance, a ski boot would not be disengaged from a ski.

In order to remove the above mentioned potential drawbacks, a second elastic member which is adjusted at a stronger tension, for example 50 Kg or so, could be employed. The second elastic member could be arranged in two different manners. In the first modification of this embodiment, a second heel or toe clamping arm is employed. This second heel or toe clamping arm is hinged to the first heel or toe clamping arm and is allowed to swing only in the direction departing from the first heel or toe clamping arm. Namely, the second elastic member is arranged to urge the second heel or toe clamping arm toward the first heel or toe clamping arm. Accordingly, even if a user has fallen precisely forward or backward and the pendulum is not allowed to swing, the second elastic member shrinks to allow the second heel or toe clamping arm to swing in the direction departing from the first heel or toe clamping arm, resultantly disengaging a ski boot from a ski. In the second modification of this embodiment, a second elastic member is embeded at the top end of the pendulum. In other words, the top end of the pendulum is provided with a recess in which the second elastic member, specifically a compression spring, and a plunger are embeded and the top end of the plunger projects outside the recess. The hungover end of the heel or toe clamping arm could be kept in contact with the projection of the pendulum with a marginal pressure which does not hamper the pendulum to swing. They are of course allowed to be kept apart remaining a marginal clearance therebetween.

In either modification, a ski binding specifically a heel clamp or a toe clamp in accordance with this embodiment has two functions. The first is just identical to that which is inherent to the above mentioned generic configuration. The second is that whenever a heel clamp or a toe clamp is applied a much stronger force, for example 50 Kg in the vertical direction and 20 Kg in the horizontal direction respectively, than the force, at which the first elastic member is adjusted to function, for example 5 Kg a disengagement is realized to prevent an injury from occurring.

The situation is similar to the above mentioned generic case in that various minor modifications and design preferences are available for this embodiment.

Further, a heel clamp or a toe clamp is available which is provided with plural clamping units each of which consists of a first heel or toe clamping arm, a first elastic member which urges the first heel or toe clamping arm toward a ski boot, a second heel or toe clamping arm, a second elastic member which urges the second elastic member toward the first elastic member for the ultimate purpose to urge the second heel or toe clamping arm toward the ski boot and an end or a projection of a pendulum commonly employed for all the units, the end or projection of the pendulum being employed to lock or unlock the heel or toe clamping arm. Particularly, a heel clamp or a toe clamp provided with three clamping units, one of which is employed in the vertical direction and the others of which are employed in the horizontal direction is realistic.

It may be evident that since this embodiment is provides with the maximum safety in any direction, it is appropriate for beginners.

It frequently occurs that much flexibility is desired for the vertical direction and much rigidity is desired for the horizontal direction. This presumably effective to simultaneously enable a stronger heel thrust (Fersen Schub) and a large magnitude of safety.

In order to realize the above mentioned preferable performance, a heel clamp or a toe clamp is available which is provided with a set of clamping units having the same configuration as is presented in the second embodiment, arranged in the vertical direction and with two sets of clamping units having the same configuration as is presented in the first embodiment, arranged in the horizontal direction. In other words, this third embodiment would be a type of hybrid of the first embodiment which has a better control of skis and the second embodiment which has a better magnitude of safety. This configuration is effective to enable a large heel thrust (Fersen Schub) due to the rigidity of the horizontal clamping units and a better magnitude of safety due to the flexibility of the vertical clamping unit.

In order to improve the performance against a lateral shock applied to the front end of a ski during the user's action to change the sliding direction of skis, it is effective to provide a pivot pin on a ski engaging a recess provided in the sole of a ski boot in combination with any of the heel clamps mentioned above and the toe clamps mentioned above or available in the prior art. This effect can be justified as follows. (1) the pivot is arranged practically under the ball of a foot. It is noted that the combined snow resistance is applied in the neighborhood of this point. Therefore, the combined snow resistance scarely applies a force to twist a ski boot with respect to a ski, resultantly causing no effect to disengage the ski boot from the ski. (2) A heel thrust (Ferson Schub) is effective to disengage a side heel clamping unit on on side and a side toe clamping unit on the other side. This means the heel thrust is split to be applied to two independent clamping units. (3) A shock applied to the front end of a ski is seldom applied to the same clamping units as receives the effects of the heel thrust (Fersen Schub). (4) This means the shock applied to the front end of the ski and the effect caused by the heel thrust (Fersen Schub) are cancelled by each other, resulting in a less possibility of unintentional disengagement of a ski boot from a ski. Accordingly, this configuration is effective to increase the mangitude of safety without devastating the control of skis or is effective to improve the control of skis without reducing the magnitude of safety.

BRIEF DESCRIPTION OF THE DRAWINGS

My invention, together with its various features and advantages, can be readily understood from the following more detailed description presented in conjunction with the following drawings, in which.

DETAILED DESCRIPTION OF VARIOUS EMBODIMENTS

Figure 1:
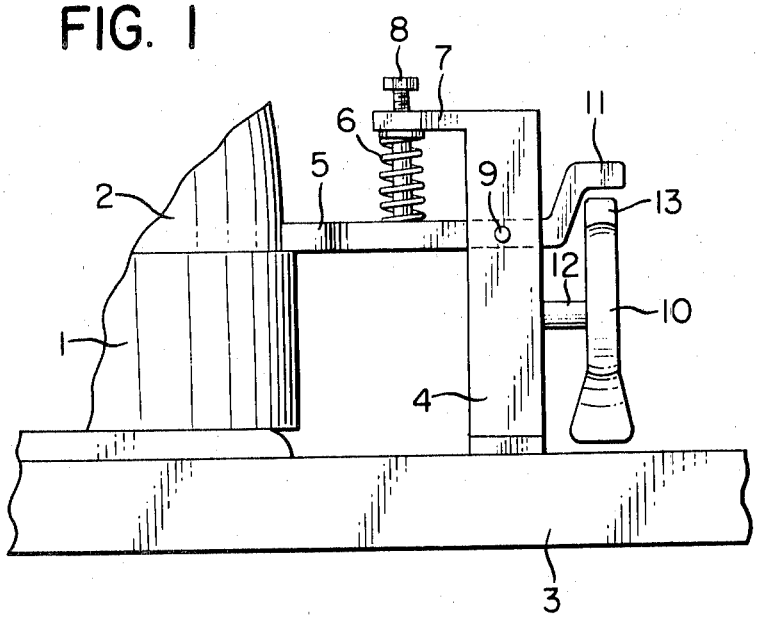
FIG. 1 is an elevational view of a heel clamp in accordance with an embodiment of this invention.
Figure 2:
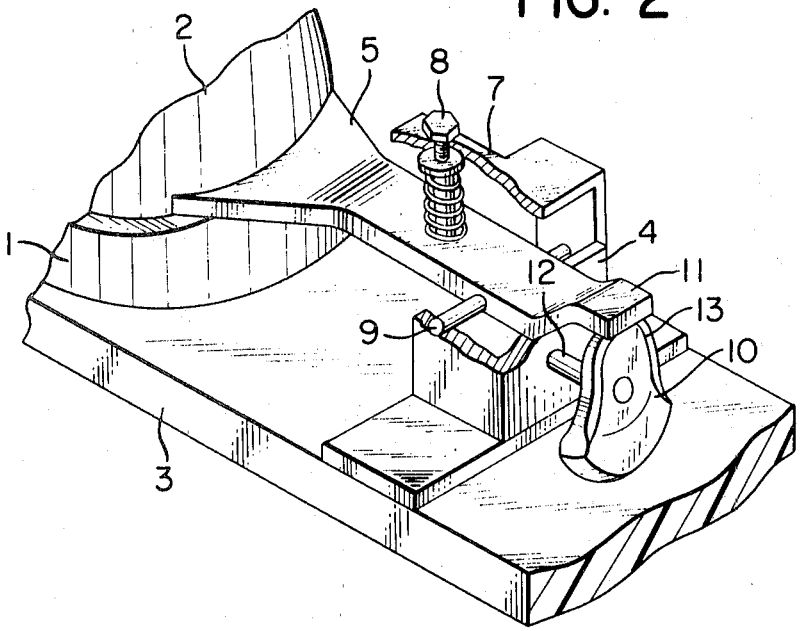
FIG. 2 is a partly cutaway perspective view of a heel clamp in accordance with the embodiment of this invention of which the elevational view is shown in FIG. 1.

Referring to FIGs. 1 and 2, numeral 1 indicates either the toe or the heel of a ski boot 2 which is to be clamped with a ski 3. Numeral 4 is a post fitted on the top surface of the ski 3. A heel clamping arm 5 supported by the post 4 is allowed to swing in a vertical direction. A compressed compression spring 6 is arranged between the top surface of the heel clamping arm 5 and the lower surface of a branch 7 of the post 4. The tension of the compressed compression spring 6 is adjustable by means of a screw 8 arranged on top of the branch 7. The tension of the spring 6 causes the heel clamping arm 5 to downwardly urge the edge of the heel 1 of the ski boot 2 with a relatively small amount of force, for example 5 Kg which is the maximum amount of force which never causes an injury for any part of a user's body, regardless the manner of fall and the like. The heel clamping arm 5 overhangs or extends toward the other direction beyond the supporting shaft 9. A pendulum 10 arranged below the hungover end 11 of the heel clamping arm 5 is allowed to swing around a shaft 12 fitted on the side of the post 4. Under the normal use of the skis or when no upward abnormal force is applied to the heel clamping arm 5 to lift the heel 1 apart from the ski 3, a clearance is maintained between the lower surface of the hungover end 11 of the heel clamping arm 5 and the round top end 13 of the pendulum 10. In combination with the heel clamp having the configuration shown above, any conventional toe clamp (not shown) is allowed to be employed.

As previously stated, the tension of the spring 6 is adjusted to be strong enough not to disengage the heel 1 from the ski 3 under the normal use of the skis. In addition, even if a force stronger than the predetermined amount, for example 5 Kg, is applied upwardly to the heel clamping arm 5, the heel 1 is not disengaged from the ski, because the hungover end 11 of the heel clamping arm 5 is located by the top end 13 of the pendulum 10, during the period in which the pendulum stays in the original position. Therefore, a sufficient magnitude of control is allowed for a user, while the user is enjoying sking under the normal condition. In the event, however, that the user has fallen aside or a ski receives a sideways shock, the pendulum 10 swings and changes the position from the original position, and the heel clamp disengages the heel 1 from the ski 3, because the pendulum 10 is in an unlocked position, resultantly preventing a possibility of injury particularly for beginners who are inclined to fall aside at a low speed and also are inclined to use a relatively small amount of force for control of skis. It is a supplemental advantage that any of the conventional toe clamps is allowed to be employed in combination with this embodiment.

The location and nature of the spring 6 allows some modifications for this embodiment. The first modification employs a compressed compression spring arranged between the under surface of the hungover end 11 of the heel clamping arm 5 and the top surface of the ski 3. The second modification employs an expanded expansion spring arranged between the under surface of the heel clamping arm 5 and the top surface of the ski 3. The third modification employs an expanded expansion spring arranged between the under surface of a branch extending from the post 4 to the other side of the branch 7 and the top surface of the hungover end 11 of the heel clamping arm 5. The fourth modification employs a leaf spring which extends along the hungover end of the heel clamping arm 5 and is pulled by a post standing on the ski 3.

It may be needless to express that a means for adjusting the location of the post along the length of the ski and a cover protecting the heel clamp from snow and/or ice are preferable.

It must be emphasized, however, that this configuration can be utilized for production of a toe clamp.

The above mentioned generic embodiment is involved with some potential drawbacks. Firstly, if a user has fallen precisely forward, possibilities of an injury can not be denied, because possibilities the pendulum 10 may not displace from the lock position. On the other hand, since the number of the heel clamping arm 5 is only one and also since the clamping force is applied downward, an unexpected disengagement may happen sideways. Therefore, the end of the heel clamping arm 5 is desired to have a shape partly surrounding the heel 1. This shape of the end of the heel clamping arm 5 increases the above mentioned possibility of injury. Secondly, if a user has fallen sideways during the period in which the hungover end 11 keeps contact with and is locked by the top end 13 of the pendulum 10 by some chance, heel 1 may not disengage from the ski 3. Thirdly, it is frequently experienced that the ski 3, particularly the front end thereof, receives strong shocks in the lateral direction, causing an unexpected disengagement of the ski boot 2 from the ski 3.

Figure 3:
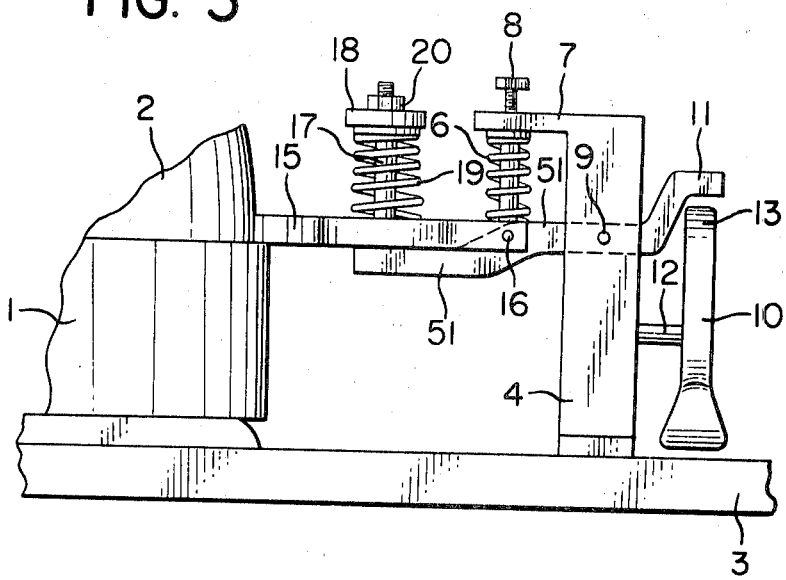
FIG. 3 is an elevational view of a heel clamp in accordance with another embodiment of this invention which is improved in the safety particularly in the event that a user has fallen sideways.
Figure 4:
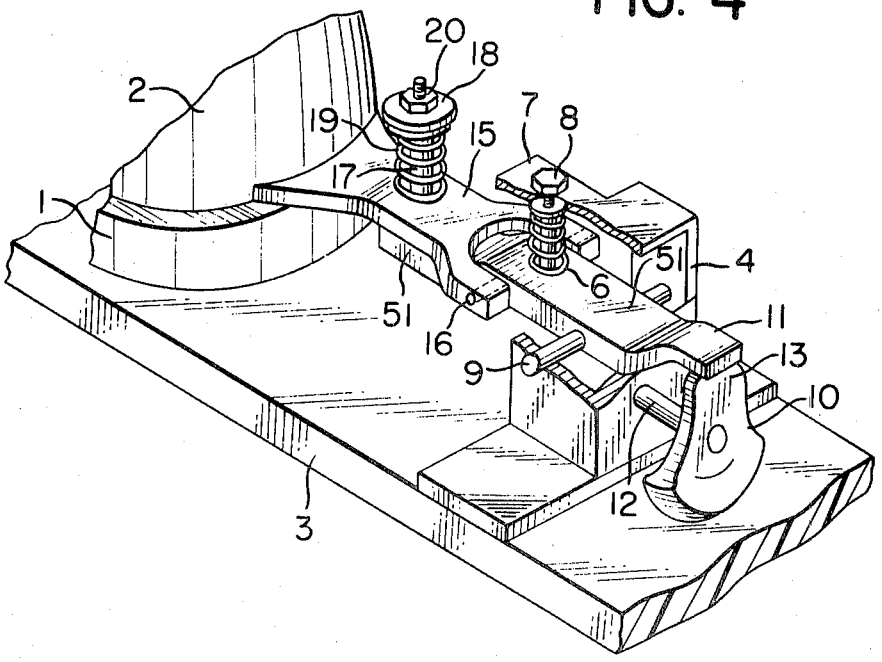
FIG. 4 is a partly cutaway perspective view of a heel clamp of the elevational view of FIG. 3.

An embodiment is illustrated in FIGS. 3 and 4 removes the first one of the above mentioned drawbacks. Referring to FIGS. 3 and 4, numerals 1 through 4 and 6 through 13 indicate respectively each of the corresponding members illustrated in FIGS. 1 and 2. In this embodiment, however, a first heel clamping arm 51 has a shape with a type of double stages as shown in the figure. The first heel clamping arm 51 rotatably supports a second heel clamping arm 15 which is hinged by a horizontal shaft 16 and of which the under surface is supported by the upper surface of the first heel clamping arm 51. The first heel clamping arm 51 is provided with a vertical pillar 17 standing on the top surface thereof. The vertical pillar 17 is provided with a head plate 18 which compresses a second spring 19 arranged between the under surface of the head plate 18 and the upper surface of the second heel clamping arm 15. The tension of the second spring 19 can be adjusted by means of a second screw 20 arranged on top of the head plate 18.

The tension of the second spring 19 is adjusted to be larger than that of the spring 6, for example 50 kg. In the event that a user has fallen precisely forward, the spring 6 is first compressed to cause the hungover end 11 to contact with the top end of the pendulum 10. If the force applied to the second heel clamping arm 15 is sufficiently large, it compresses the second spring 19, after the hungover end 11 of the first heel clamping arm 51 is locked by the top end 13 of the pendulum 10, to disengage the ski boot 2 from the ski 3. It is needless to emplasize that all the advantages inherent to the embodiment of which the configuration is illustrated in FIGS. 1 and 2 are entirely maintained for this embodiment. As a result, in addition to the sufficient magnitude of control, the magnitude of safety is also considerably improved particularly for the event in which the user has fallen precisely forward.

Figure 5:
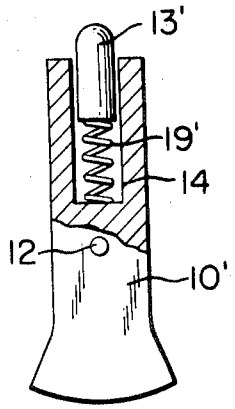
FIG. 5 is an elevational view of a pendulum employed for a further embodiment of this invention wherein te improvement is applied to the structure of the pendulum to give a function similar to that of the embodiment of which the configuration is illustrated in FIGS. 3 and 4.

As described in the Summary of the Invention, another embodiment is available to realize the similar function in which elasticity is given to the top end of the pendulum. Referring to FIG. 5, a second spring 19' is embeded in a recess 14 provided at the top end of a pendulum 10'. On top of the second spring 19' arranged in the recess 14, a plunger 13' is arranged to face the under surface of the hungover end 11 with a marginal clearance or to contact the under surface of the hungover end 11 with a marginal pressure which does not hamper the pendulum 10' to swing. The function of this modification is quite similar to that of the above mentioned modification. Namely, in the event that a user has fallen precisely forward and the spring 6 is first compressed to cause the hungover end 11 to be locked by the plunger 13', the spring 19' shrinks to disengage the ski boot 2 from the ski 3, if the force applied to the heel clamping arm 5 is sufficiently large.

It must be emphasized that the configuration of either of the modification of this embodiment can be utilized for production of a toe clamp.

Figure 8A:
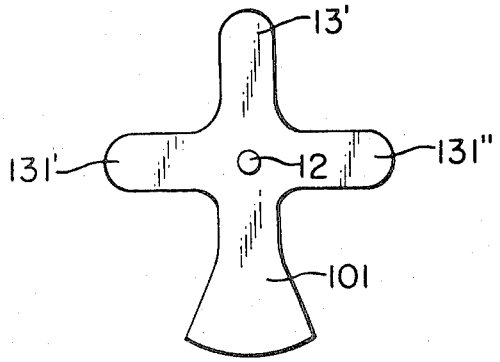
Figure 8B:
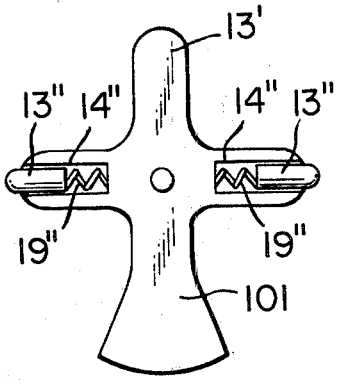
Figure 6:
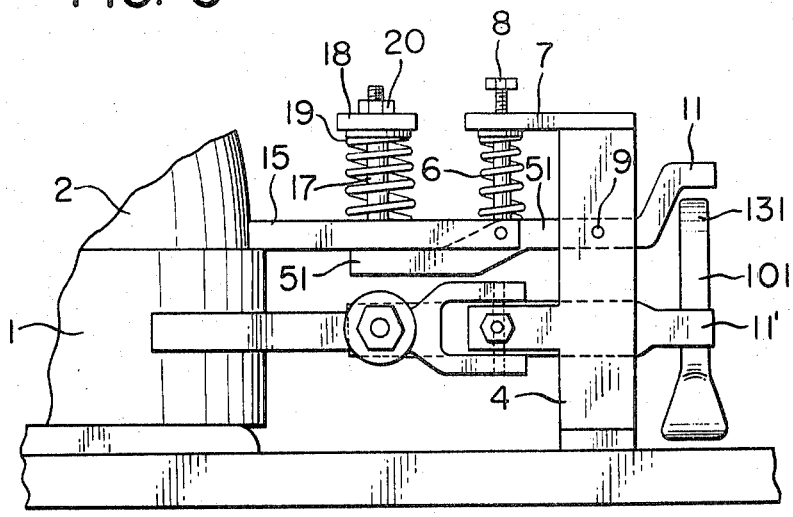
FIG. 6 is an elevational view of a heel clamp in accordance with an additional embodiment of this invention which is improved in the safety particularly in the event that a user has fallen sideways.
Figure 7:
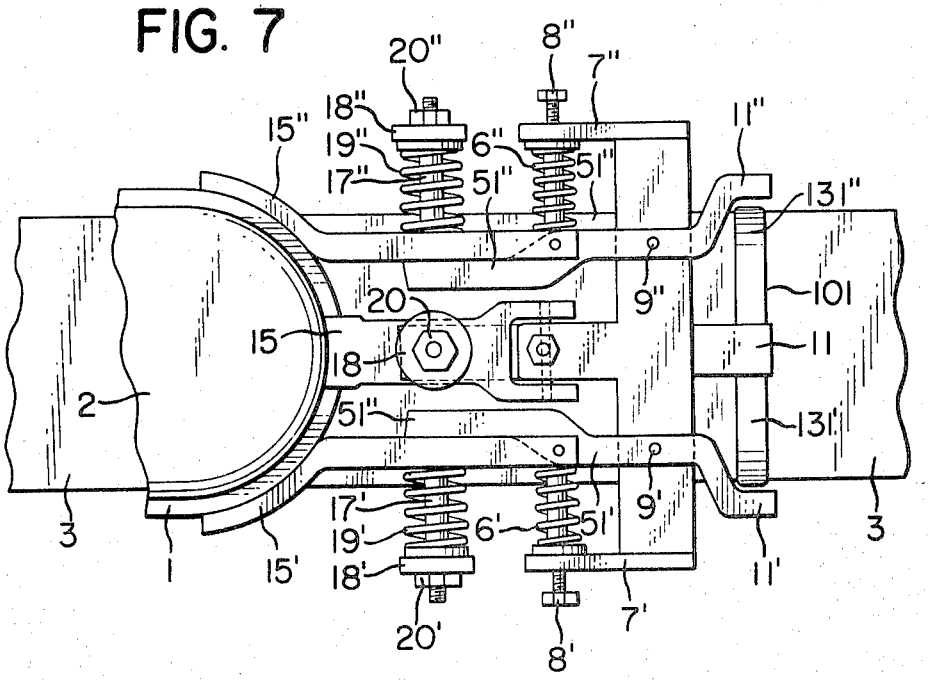
FIG. 7 is a plan view of a heel clamp in accordance with the elevational view of FIG. 6, FIG. 8(*a*) is an elevational view of a pendulum employed for the additional embodiment of FIG. 6, FIG. 8(*b*) is an elevational view of a modified form of the pendulum shown in FIG. 8(*a*)

An embodiment of which the configuration is illustrated in FIGS. 6 and 7 removes all of the above mentioned drawbacks. Referring to FIGS. 6 and 7, all the numerals excepting 10 and 13 indicate respectively each of the corresponding members illustrated in FIGS. 3 and 4. In this embodiment, however, three heel clamping units having quite similar configuration to one another are employed in three different directions, one for the vertical direction and two for the horizontal direction. In this specification, a clamping unit is defined as a group of members consisting of a clamping arm, an elastic member urging the clamping arm and an end or a projection of a pendulum. The group of members having numerals with no dash indicates the vertical heel clamping units and the groups of members having numerals with one dash or two dashes respectively indicate each of the horizontal heel clamping units. It is clear that the vertical heel clamping unit functions to disengage a ski boot 2 from a ski 3, whenever an excess force is applied to the ski boot 2 in the vertical direction and each of the horizontal heel clamping units functions to disengage the ski boot 2 from the ski 3, whenever an excess force including a sidewise shock is applied to the ski boot 2 in the horizontal direction. Therefore, the pendulum 101 is required to have a shape resembling to a three dimensional cam as shown in FIG. 8. Referring to FIG. 8, numerals 131, 131' and 131'' respectively indicate each end or projection of the pendulum 101 respectively facing hungover ends 11, 11' and 11''. Pendulum 101 may be provided with a pair of recesses 14'', second springs 19'' and plungers 13'' to give elasticity to the laterally facing ends of pendulum 101 in a manner similar to that described in connection with FIG. 5.

It must be emphasized that the configuration of this embodiment can be utilized for production of a toe clamp.

Just from the experience, it is determined that flexibility is preferable to rigidity for the vertical clamping units, for protection of a user from an injury and that rigidity is preferable to flexibility for the horizontal clamping units, to enable a more powerful control of skis employing a larger amount of heel thrust (Fersen Schub). These two independent requirements are simultaneously realized by employment of a vertical heel or toe clamping unit having the configuration shown in FIGS. 3 and 4 and two horizontal heel or toe clamping units having the configuration shown in FIGS. 1 and 2. This hybrid embodiment would be preferable to any of the above presented embodiments from the practical viewpoints, because a better control of skis due to a large heel thrust (Fersen Schub) and a large magnitude of safety due to the double-stage function implemented by the vertical heel or toe clamping unit are simultaneously realized.

It must be emphasized that this configuration can be utilized for production of either a toe clamp or a heel clamp.

As mentioned earlier, most of the heel clamps in the prior art are designed to allow a ski boot to rotate around the heel to be disengaged from a ski. This means that a latent pivot or invisible pivot is assumed under a heel. Again as mentioned earlier, this latent or invisible pivot located under the heel is a parameter of unintentional disengagement of a ski boot from a ski particularly in the event that a lateral shock is applied at the front end of a ski.

Any configuration in accordance with this invention can be utilized for production of either a heel clamp or a toe clamp. If both toe clamps and heel clamps have side clamping units as shown in FIGS. 3 and 4, the latent or invisible pivot would move to the center of a ski boot. This location of the latent or invisible pivot is effectiveto allow both the toe side clamping unit and the heel side clamping unit simultaneously to function for disengagement of a ski boot from a ski, considerably improving the performance particularly against a lateral shock applied to the front end of a ski during a user's action to change the sliding direction of skis.

Figure 9:
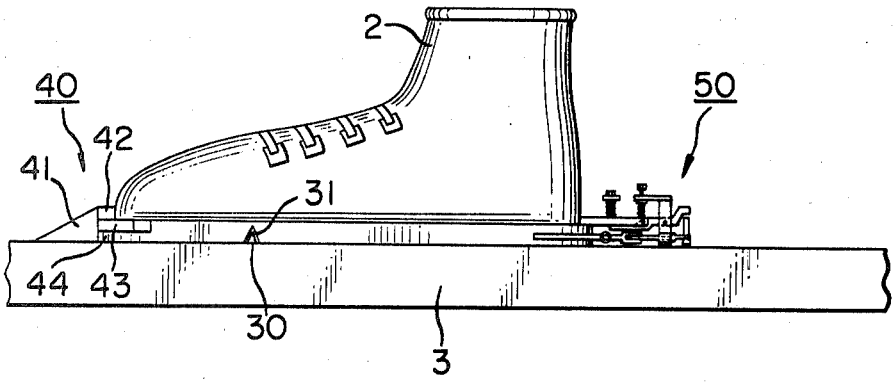
FIG. 9 is an elevational view of a ski binding in accordance with a further additional embodiment of this invention which is further improved in the function against a shock applied to the front side end of a ski, thereby provided with the maximum control and safety for all cases.
Figure 10:
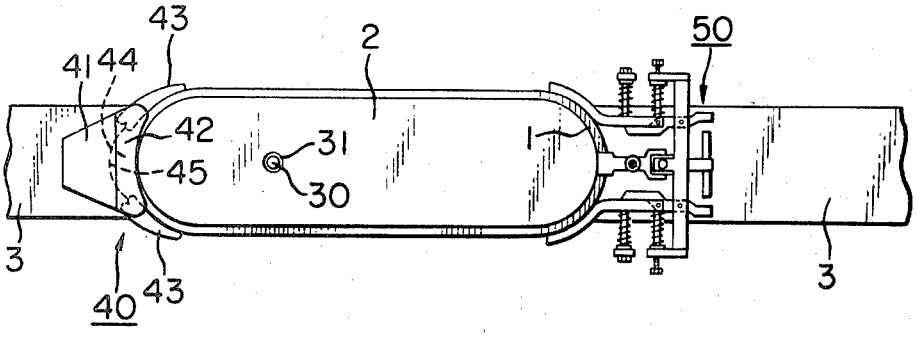
FIG. 10 is a plan view of a ski binding in accordance with the elevational view of FIG. 9.

Further, it is clear that an actual or visible pivot provided on a ski engaging a recess provided in the sole of a ski boot is effective to enhance the above mentioned effects. FIGS. 9 and 10 illustrate the configuration of an example of this embodiment, which is provided with a pivot pin arranged on a ski to be engaged with recess provided in the sole of a ski boot in combination with a heel clamp of which the configuration is illustrated in FIGS. 6 and 7 and with a toe clamp available in the prior art. Referring to FIGS. 9 and 10, numeral 1 indicates a heel of a ski boot 2 which is clamped on a ski 3.

A pivot pin 30 is arranged on the ski 3 to be engaged with a recess 31 provided in the sole of the boot 2. This embodiment is further provided with a toe clamp 40 which comprises a housing 41, an upper toe clamping member 42, a pair of jaws 43 which inwardly clamp the toe 44 of the ski boot 2. Numeral 50 indicates a heel clamp of which the configuration is illustrated in FIGS. 6 and 7.

The function of this embodiment is quite similar to that of the embodiment of which the configuration is shown in FIGS. 6 and 7, in the event that a user has fallen forward and/or sideways. Against the shocks applied at the front end of a ski in the lateral direction, however, the function of this embodiment is considerably different from that of any of the above mentioned embodiments. For example, presented below will be the behavior of this embodiment in the event that a lateral shock is applied at the front end of a ski from right to left during the period in which a user is taking an action to change the sliding direction of skis from right to left. Since the pivot 30 is provided under the ball of a foot, the combined snow resistance does not affect to disengage the ski boot 2 from the ski 3, because it is directly applied to the ski boot 2 through the pivot 30. A heel thrust (Fersen Schub) applied at a point slightly ahead of this heel affects to disengage the right side heel clamping unit and the left side toe clamping unit or jaw 43. On the other hand, a lateral shock applied at the right front end of the ski 3 affects to change the direction of the ski 3 to the left with respect to the ski boot 2. This means the shock affects to disengage the right side toe clamping unit or jaw 43 and the left side heel clamping unit. Therefore, the effects of the heel thrust (Fersen Schub) and the lateral shock are cancelled by each other, resulting in little possibility of unintentional or undesired disengagement of the ski boot 2 from the ski 3.

Accordingly, a ski binding which firmly clamps a ski boot with a ski under a normal use of skis for allowing the best control of skis for a user, readily disengages the ski boot from the ski in the event that disengagement is desired for protection of the user, and effectively prevents unintentional or undesired disengagement of the ski boot from the ski in the event that a lateral shock is applied to the front side of the ski, from occurring, is provided.

Although the invention has been described with reference to specific embodiments, this description is not meant to be construed in a limiting sense. Various modifications of the disclosed embodiments, as well as other embodiments of the invention, will become apparent to persons skilled in the art upon reference to the description of the invention. It is therefore contemplated that the apended claims will cover any such modifications or embodiments as fall within the true scope of the invention.

What is claimed is:

1. A heel clamp of a ski binding comprising:

at least one heel clamping arm each of which clamps the heel of a ski boot with a ski, each of said heel clamping arms having a hungover end, a post rotatably supporting said at least one heel clamping arm, said post being fitted on the top surface of said ski, at least one elastic member each of which urges the corresponding one of said heel clamping arms toward said heel of said ski boot with respect to said post so that each of said heel clamping arms directly clamps said heel of said ski, and a pendulum rotatably supported by said post, said pendulum having ends each of which faces the corresponding one of said hungover ends of said heel clamping arms, remaining a small amount of clearance therebetween, whereby said heel is clamped with said ski under a normal use of skis, but said heel is disengaged from said ski in the event that a user of said skis has fallen sideways at a slow speed.

2. A heel clamp of a ski binding defined in claim 1, wherein the number of said heel clamping arm, said elastic member, said end of said pendulum and said hungover end of said heel clamping arm is respectively one and said heel clamping arm is downwardly urged by said elastic member.

3. A heel clamp of a ski binding defined in claim 1, wherein the number of said heel clamping arm, said elastic member, said end of said pendulum and said hungover end of said heel clamping arm is respectively three and one of said heel clamping arms is downwardly urged and two of said heel clamping arms are urged sideways by the corresponding one of said elastic members.

4. A toe clamp of a ski binding comprising:

at least one toe clamping arm each of which clamps the toe of a ski boot with a ski, each of said toe clamping arms having a hungover end, a post rotatably supporting said at least one toe clamping arm, said post being fitted on the top surface of said ski, at least one elastic member each of which urges the corresponding one of said toe clamping arms toward said toe of said ski boot with respect to said post so that each of said toe clamping arms directly clamps said toe of said ski, and a pendulum rotatably supported by said post, said pendulum having ends each of which faces the corresponding one of said hungover ends of said toe clamping arms, remaining a small amount of clearance therebetween, whereby said toe is clamped with said ski under a normal use of skis, but said toe is disengaged from said ski in the event that a user of said skis has fallen sideways at a low speed.

5. A toe clamp of a ski binding defined in claim 4, wherein the number of said toe clamping arm, said elastic member, said end of said pendulum and said hungover end of said toe clamping arm is respectively one and said toe clamping arm is downwardly urged by said elastic member.

6. A toe clamp of a ski binding defined in claim 4, wherein the number of said toe clamping arm, said elastic member, said end of said pendulum and said hungover end of said toe clamping arm is respectively three and one of said toe clamping arms is downwardly urged and two of said toe clamping arms are urged sideways by the corresponding one of said elastic members.

7. A heel clamp of a ski binding comprising:

at least one first heel clamping arm each of which has a hungover end, a post rotatably supporting said at least one first heel clamping arm, said post being fitted on the top surface of a ski, at least one first elastic member each of which urges the corresponding one of said first heel clamping arms toward the heel of said ski boot with respect to said post, at least one second heel clamping arm each of which is hinged on a shaft provided in the corresponding one of said first heel clamping arms and is supported on the top surface of the corresponding one of said first heel clamping arms, at least one second elastic member each of which urges the corresponding one of said second heel clamping arms towards said heel of said ski boot with respect to the corresponding one of said first heel clamping arms so that said second heel clamping arms directly clamp said heel of said ski, and a pendulum rotatably supported by said post, said pendulum having ends each of which faces the corresponding one of said hungover ends of said first heel clamping arms, remaining a small amount of clearance therebetween, whereby said heel is clamped with said ski under a normal use of skis, but said heel is disengaged from said ski in the event that a user of said skis has fallen forward or sideways at a slow speed.

8. A heel clamp of a ski binding defined in claim 7, wherein the number of said first heel clamping arm, said first elastic member, said second heel clamping arm, said second elastic member, and said hungover end of said first heel clamping arm is respectively one and said first and second heel clamping arms are downwardly urged by said elastic member.

9. A heel clamp of a ski binding defined in claim 7, wherein the number of said first heel clamping arm, said first elastic member, said second heel clamping arm, said second elastic member and said hungover end of said first heel clamping arm is respectively three and one of said first and second heel clamping arms is downwardly urged and two of said first and second heel clamping arms are urged sideways by the corresponding one of said first and second elastic members.

10. A toe clamp of a ski binding comprising:

at least one first toe clamping arm each of which has a hungover end, a post rotatably supporting said at least one first toe clamping arm, said post being fitted on the top surface of a ski, at least one first elastic member each of which urges the corresponding one of said first toe clamping arms toward the toe of said ski boot with respect to paid post, at least one second toe clamping arm each of which is hinged on a shaft provided in the corresponding one of said first toe clamping arms and is supported on the top surface of the corresponding one of said first toe clamping arms, at least one second elastic member each of which urges the corresponding one of said second toe clamping arms toward said toe of said ski boot with respect to the corresponding one of said first toe clamping arms so that said second toe clamping arms directly clamp said toe of said ski, and a pendulum rotatably supported by said post, said pendulum having ends each of which faces the corresponding one of said hungover ends of said first toe clamping arms, remaining a small amount of clearance therebetween, whereby said toe is clamped with said ski under a normal use of skis, but said toe is disengaged from said ski in the event that a user of said skis has fallen forward or sideways at a slow speed.

11. A toe clamp of a ski binding defined in claim 10, wherein the number of said first toe clamping arm, said first elastic member, said second toe clamping arm, said second elastic member, and said hungover end of said first toe clamping arm is respectively one and said first and second toe clamping arms are downwardly urged by said elastic ember.

12. A toe clamp of a ski binding defined in claim 10, wherein the number of said first toe clamping arm, said first elastic member, said second toe clamping arm, said second elastic member and said hungover end of said first toe clamping arm is respectively three and one of said first and second toe clamping arms is downwardly urged and two of said first and second toe clamping arms are urged sideways by the corresponding one of said first and second elastic members.

13. A heel clamp of a ski binding comprising:

at least one heel clamping arm each of which clamps the heel of a ski boot with a ski, each of said heel clamping arms having a hungover end, a post rotatably supporting said at least one heel clamping arm, said post being fitted on the top surface of said ski, at least one first elastic member each of which urges the corresponding one of said heel clamping arms toward said heel of said ski boot with respect to said post so that each of said heel clamping arms directly clamps said heel of said ski, and a pendulum rotatably supported by said post and having ends each of which faces the corresponding one of said hungover ends of said heel clamping arms, said each end of said pendulum having a recess in which a plunger is arranged on top of a second elastic member arranged at the bottom of said recess, whereby said heel is clamped with said ski under a normal use of skis, but said heel is disengaged from said ski in the event that a user of said skis has fallen forward or sideways at a slow speed.

14. A heel clamp of a ski binding defined in claim 13, wherein the number of said heel clamping arm, said first elastic member, said end of said pendulum, and said second elastic member is respectively one and said heel clamping arm is downwardly urged.

15. A heel clamp of a ski binding defined in claim 13, wherein the number of said heel clamping arm, said first elastic member, said end of said pendulum, and said second elastic member is respectively three and one of said heel clamping arms is downwardly urged and two of said heel clamping arms are urged sideways.

16. A toe clamp of a ski binding comprising:

at least one toe clamping arm each of which clamps the toe of a ski boot with a ski, each of said toe clamping arms having a hungover end, a post rotatably supporting said at least one toe clamping arm, said post being fitted on the top surface of said ski, at least one first elastic member each of which urges the corresponding one of said toe clamping arms toward said toe of said ski boot with respect to said post so that each of said toe clamping arms directly clamps said toe of said ski, and a pendulum rotatably supported by said post and having ends each of which faces the corresponding one of said hungover ends of said toe clamping arms, said each end of said pendulum having a recess in which a plunger is arranged on top of a second elastic member arranged at the bottom of said recess, whereby said toe is clamped with said ski under a normal use of skis, but said heel is disengaged from said ski in the event that a user of said skis has fallen forward or sideways at a slow speed.

17. A toe clamp of a ski binding defined in claim 16, wherein the number of said toe clamping arm, said first elastic member, said end of said pendulum, and said second elastic member is respectively one and said toe clamping arm is downwardly urged.

18. A toe clamp of a ski binding defined in claim 16, wherein the number of said toe clamping arm, said first elastic member, said end of said pendulum, and said second elastic member is respectively three and one of said toe clamping arms is downwardly urged and two of said toe clamping arms are urged sideways.

19. A heel clamp of a ski binding comprising:

at least one first heel clamping unit comprising a heel clamping arm which clamps the heel of a ski boot with a ski and has a hungover end thereof facing an end of a pendulum, remaining a small amount of clearance therebetween, and an elastic member which urges said heel clamping arm toward said heel of said ski boot, at least one second heel clamping unit comprising a first heel clamping arm which has a hungover end thereof facing an end of said pendulum, remaining a small amount of clearance therebetween, a first elastic member which urges said first heel clamping arm toward said heel of said ski boot, a second heel clamping arm which is hinged on a shaft provided in said first heel clamping arm and is supported on the top surface of said first heel clamping arm, and a second elastic member which urges said second heel clamping arm toward said heel of said ski boot with respect to said first heel clamping arm, and a post fitted on the top surface of said ski and rotatably supporting said at least one first heel clamping unit, said at least one second heel clamping unit and said pendulum.

20. A heel clamp of a ski binding defined in claim 19, wherein the numbers of said first heel clamping unit and said second heel clamping unit are one and two respectively and said first heel clamping unit urges said heel of said ski boot downward and said second heel clamping units urge said heel of said ski boot sideways.

21. A heel clamp of a ski binding defined in claim 19, wherein the numbers of said first heel clamping unit and said second heel clamping unit are two and one respectively and said first heel clamping units urge said heel of said ski boot sideways and said second heel clamping unit urges said heel of said ski boot downward.

22. A toe clamp of a ski binding comprising:

at least one first toe clamping unit comprising a toe clamping arm which clamps the toe of a ski boot with a ski and has a hungover end thereof facing an end of a pendulum, remaining a small amount of clearance therebetween, and an elastic member which urges said toe clamping arm toward said toe of said ski boot, at least one second toe clamping unit comprising a first toe clamping arm which has a hungover end thereof facing an end of said pendulum, remaining a small amount of clearance therebetween, a first elastic member which urges said first toe clamping arm toward said toe of said ski boot, a second toe clamping arm which is hinged on a shaft provided in said first toe clamping arm and is supported on the top surface of said first toe clamping arm, and a second elastic member which urges said second toe clamping arm toward said toe of said ski boot with respect to said first toe clamping arm, and a post fitted on the top surface of said ski and rotatably supporting said at least one first toe clamping unit and said pendulum.

23. A toe clamp of a ski binding defined in claim 22, wherein the numbers of said first toe clamping unit and second toe clamping unit are one and two respectively and said first toe clamping unit urges said toe of said ski boot downward and said second toe clamping units urge said toe of said ski boot sideways.

24. A toe clamp of a ski binding defined in claim 22, wherein the numbers of said first toe clamping unit and said second toe clamping unit are two and one respectively and said first toe clamping units urge said toe of said ski boot sideways and said second toe clamping unit urges said heel of said ski boot downward.

25. A heel clamp of a ski binding comprising:

at least one heel clamping arm each of which clamps the heel of a ski boot with a ski, each of said heel clamping arms having a hungover end, a post rotatably supporting said at least one heel clamping arm, said post being fitted on the top surface of said ski, at least one first elastic member each of which urges the corresponding one of said heel clamping arms toward said heel of said ski boot with respect to said post, and a pendulum rotatably supported by said post and having ends each of which faces the corresponding one of said hungover ends of said heel clamping arms, at lest one of said ends of said pendulum having a recess in which a plunger is arranged on top of a second elastic member arranged at the bottom of said recess.

26. A heel clamp of ski binding defined in claim 25, wherein the number of said recess is one and said recess is provided to face the one of said ends of said heel clamping arms which urges said heel of said ski boot downward.

27. A heel clamp of ski binding defined in claim 25, wherein the number of said recess is two and said recesses are provided to face the ones of said ends of said heel clamping arms which urge said heel of said ski boot sideways.

28. A toe clamp of a ski binding comprising:

at least one toe clamping arm each of which clamps the toe of a ski boot with a ski, each of said toe clamping arms having a hungover end, a post rotatably supporting said at least one toe clamping arm, said post being fitted on the top surface of said ski, at least one first elastic member each of which urges the corresponding one of said toe clamping arms toward said toe of said ski boot with respect to said post, and a pendulum rotatably supported by said post and having ends each of which faces the corresponding one of said hungover ends of said toe clamping arms, at last one of said ends of said pendulum having a recess in which a plunger is arranged on top of a second elastic member arranged at the bottom of said recess.

29. A toe clamp of ski binding defined in claim 28, wherein the number of said recess is one and said recess is provided to face the one of said ends of said toe clamping arms which urges said toe of said ski boot downward.

30. A toe clamp of ski binding defined in claim 28, wherein the number of said recess is two and said recesses are provided to face the ones of said ends of said toe clamping arms which urge said toe of said ski boot sideways.

31. A ski binding comprising:

a pivot pin provided on a ski to be engaged with a recess provided in the sole of a ski boot, a toe clamp comprising a housing, an upper toe clamping member and a pair of jaws rotatable sideways and urged inwardly, and a heel clamp comprising three heel clamping units each of which comprises a first heel clamping arm which has a hungover end thereof facing an end of a pendulum, remaining a small amount of clearance therebetween, a fist elastic member which urges said first heel clamping arm toward said heel of said ski boot, a second heel clamping arm which is hinged on a shaft provided in said first heel clamping arm and is supported on the top surface of said first heel clamping arm, and a second elastic member which urges said second heel clamping arm toward said heel of said ski boot with respect to said first heel clamping arm, one of said heel clamping units clamping said heel of said ski boot downward and two of said heel clamping units clamping said heel of said ski boot sideways, and a post fitted on the top surface of said ski and rotatably supporting said three heel clamping units and said pendulum.

32. A ski binding comprising:

a pivot pin provided on a ski to be engaged with a recess provided in the sole of a ski boot, a toe clamp comprising a housing, an upper toe clamping member and a pair of jaws rotatable sideways and urged inwardly, and a heel clamp comprising three heel clamping arms one of which clamps the heel of said ski boot downwardly with said ski and two of which clamp said heel of said ski boot sideways with said ski, each of said heel clamping arms having a hungover end, a post rotatably supporting said three heel clamping arms, said post being fitted on the top surface of said ski, three first elastic members each of which urges the corresponding one of said heel clamping arms toward said heel of said ski boot with respect to said post, and a pendulum rotatably supported by said post and having ends each of which faces the corresponding one of said hungover ends of said heel clamping arms, said each end of said pendulum having a recess in which a plunger is arranged on top of a second elastic member arranged at the bottom of said recess.

33. A ski binding comprising:

a pivot pin provided on a ski to be engaged with a recess provided in the sole of a ski boot, a toe clamp comprising a housing, an upper toe clamping member and a pair of jaws rotatable sideways and urged inwardly, and a heel clamp comprising two first heel clamping units each of which comprises a heel clamping arm which clamps the heel of said ski boot sideways with said ski and has a hungover end thereof facing an end of a pendulum, remaining a small amount of clearance therebetween, and an elastic member which urges said heel clamping arm toward said heel of said ski boot, one second heel clamping unit which comprises a first heel clamping arm which clamps said heel of said ski boot downwardly and which has a hungover end thereof facing an end of said pendulum, remaining a small amount of clearance therebetween, a first elastic member which urges said first heel clamping arm toward said heel of said ski boot, a second heel clamping arm which is hinged on a shaft provided in said first heel clamping arm and is supported on the top surface of said first heel clamping arm, and a second elastic member which urges said second heel clamping arm toward said heel of said ski boot with respect to said first heel clamping arm, and a post fitted on the top surface of said ski and rotatably supporting said two first heel clamping units, one second heel clamping unit and said pendulum.

34. A ski binding comprising:

a pivot pin provided on a ski to be engaged with a recess provided in the sole of a ski boot, a toe clamp comprising a housing, an upper toe clamping member and a pair of jaws rotatable sideways and urged inwardly, and a heel clamp comprising three heel clamping arms, one of which clamps the heel of said ski boot downwardly with said ski and two of which clamp said heel of said ski boot sideways with said ski, each of said heel clamping arms having a hungover end, a post rotatably supporting said three heel clamping arms, said post being fitted on the top surface of said ski, three first elastic members each of which urges the corresponding one of said heel clamping arms toward said heel of said ski boot with respect to said post, and a pendulum rotatably supported by said post and having ends each of which faces the corresponding one of said hungover ends of said heel clamping arms, vertical one of said ends of said pendulum having a recess in which a plunger is arranged on top of a second elastic member arranged at the bottom of said recess.

35. A ski binding comprising:

a pivot pin provided on a ski to be engaged with a recess provided in the sole of a ski boot, a toe clamp comprising three toe clamping units each of which comprises a first toe clamping arm which has a hungover end thereof facing an end of a pendulum, remaining a small amount of clearance therebetween, a first elastic member which urges said first toe clamping arm toward said toe of said ski boot, a second toe clamping arm which is hinged on a shaft provided in said first toe clamping arm and is supported on the top surface of said first toe clamping arm, and a second elastic member which urges said second toe clamping arm toward said toe of said ski boot with respect to said first toe clamping arm, one of said toe clamping units clamping said toe of said ski boot downward and two of said toe clamping units clamping said toe of said ski boot sideways, and a post fitted on the top surface of said ski and rotatably supporting said three toe clamping units and said pendulum, and a heel clamp comprising three heel clamping units each of which comprises a first heel clamping arm which has a hungover end thereof facing an end of a pendulum, remaining a small amount of clearance therebetween, a first elastic member which urges said first heel clamping arm toward said heel of said ski boot, a second heel clamping arm which is hinged on a shaft provided in said first heel clamping arm and is supported on the top surface of said first heel clamping arm, and a second elastic member which urges said second heel clamping arm toward said heel of said ski boot with respect to said first heel clamping arm, one of said heel clamping units clamping said heel of said ski boot downward and two of said heel clamping units clamping said heel of said ski boot sideways, and a post fitted on the top surface of said ski and rotatably supporting said three heel clamping units and said pendulum.

36. A ski binding comprising:

a pivot pin provided on a ski to be engaged with a recess provided in the sole of a ski boot, a toe clamp comprising three clamping arms one of which clamps the toe of said ski boot downwardly with said ski and two of which clamps said toe of said ski boot sideways with said ski, each of said toe clamping arms having a hungover end, a post rotatably supporting said three toe clamping arms, said post being fitted on the top surface of said ski, three first elastic members each of which urges the corresponding one of said toe clamping arms toward said toe of said ski boot with respect to said post, and a pendulum rotatably supported by said post and having ends each of which faces the corresponding one of said hungover ends of said toe clamping arms, said each end of said pendulum having a recess in which a plunger is arranged on top of a second elastic member arranged at the bottom of said recess, and a heel clamp comprising three heel clamping arms one of which clamps the heel of said ski boot downwardly with said ski and two of which clamp said heel of said ski boot sideways with said ski, each of said heel clamping arms having a hungover end, a post rotatably supporting said three heel clamping arms, said post being fitted on the top surface of said ski, three first elastic members each of which urges the corresponding one of said heel clamping arms toward said heel of said ski boot with respect to said post, and a pendulum rotatably supported by said post and having ends each of which faces the corresponding one of said hungover ends of said heel clamping arms, said each end of said pendulum having a recess in which a plunger is arranged on top of a second elastic member arranged at the bottom of said recess.

37. A ski binding comprising:

a pivot pin provided on a ski to be engaged with a recess provided in the sole of a ski boot, a toe clamp comprising one first toe clamping unit which comprises a toe clamping arm which clamps the toe of said ski boot downward with said ski and has a hungover end thereof facing an end of a pendulum, remaining a small amount of clearance therebetween, and an elastic member which urges said toe clamping arm toward said toe of said ski boot, two second toe clamping units each of which comprises a first toe clamping arm which clamps said toe of said ski boot sideways and which has a hungover end thereof facing an end of said pendulum, remaining a small amount of clearance therebetween, a first elastic member which urges said first toe clamping arm toward said toe of said ski boot, a second toe clamping arm which is hinged on a shaft provided in said first toe clamping arm and is supported on the top surface of said first toe clamping arm, and a second elastic member which urges said second toe clamping arm toward said toe of said ski boot with respect to said first toe clamping arm, and a post fitted on the top surface of said ski and rotatably supporting said one first toe clamping unit, two second toe clamping units and said pendulum, and a heel clamp comprising three heel clamping units each of which comprises a first heel clamping arm which has a hungover end thereof facing an end of a pendulum, remaining a small amount of clearance therebetween, a first elastic member which urges said first heel clamping arm toward said heel of said ski boot, a second heel clamping arm which is hinged on a shaft provided in said first heel clamping arm and is supported on the top surface of said first heel clamping arm, and a second elastic member which urges said second heel clamping arm toward said heel of said ski boot with respect to said first heel clamping arm, one of said heel clamping units clamping said heel of said ski boot downward and two of said heel clamping units clamping said heel of said ski boot sideways, and a post fitted on the top surface of said ski and rotatably supporting said three heel clamping units and said pendulum.

38. A ski binding comprising:

a pivot pin provided on a ski to be engaged with a recess provided in the sole of a ski boot, a toe clamp comprising three toe clamping arms one of which clamps the toe of said ski boot downwardly with said ski and two of which clamp said toe of said ski boot sideways with said ski, each of said toe clamping arms having a hungover end, a post rotatably supporting said three toe clamping arms, said post being fitted on the top surface of said ski, three first elastic members each of which urges the corresponding one of said toe clamping arms toward said toe of said ski boot with respect to said post, and a pendulum rotatably supported by said post and having ends each of which faces the corresponding one of said hungover ends of said toe clamping arms, vertical one of said ends of said pendulum having a recess in which a plunger is arranged on top of a second elastic member arranged at the bottom of said recess, and a heel clamp comprising three heel clamping arms one of which clamps the heel of said ski boot downwardly with said ski and two of which clamp said heel of said ski boot sideways with said ski, each of said heel clamping arms having a hungover end, a post rotatably supporting said three heel clamping arms, said post being fitted on the top surface of said ski, three first elastic members each of which urges the corresponding one of said heel clamping arms toward said heel of said ski boot with respect to said post, and a pendulum rotatably supported by said post and having ends each of which faces the corresponding one of said hungover ends of said heel clamping arms, said each end of said pendulum having a recess in which a plunger is arranged on top of a second elastic member arranged at the bottom of said recess.

39. A ski binding comprising:

a pivot pin provided on a ski to be engaged with a recess provided in the sole of a ski boot, a toe clamp comprising two first toe clamping units each of which comprises a toe clamping arm which clamps the toe of said ski boot sideways with said ski and has a hungover end thereof facing an end of a pendulum, remaining a small amount of clearance therebetween, and an elastic member which urges said toe clamping arm toward said toe of said ski boot, one second toe clamping unit which comprises a first toe clamping arm which clamps said toe of said ski boot downwardly and which has a hungover end thereof facing an end of said pendulum, remaining a small amount of clearance therebetween, a first elastic member which urges said first toe clamping arm toward said heel of said ski boot, a second toe clamping arm which is hinged on a shaft provided in said first toe clamping arm and is supported on the top surface of said first toe clamping arm, and a second elastic member which urges said second toe clamping arm toward said toe of said ski boot with respect to said first toe clamping arm, and a post fitted on the top surface of said ski and rotatably supporting said two first toe clamping units, one seconsd toe clamping unit and said pendulum, and a heel clamp comprising two first heel clamping units each of which comprises a heel clamping arm which clamps the heel of said ski boot sideways with said ski and has a hungover end thereof facing an end of a pendulum, remaining a small amount of clearance therebetween, and an elastic member which urges said heel clamping arm toward said heel of said ski boot, one second heel clamping unit which comprises a first heel clamping arm which clamps said heel of said ski boot downwardly and which has a hungover end thereof facing an end of said pendulum, remaining a small amount of clearance therebetween, a first elastic member which urges said first heel clamping arm toward said heel of said ski boot, a second heel clamping arm which is hinged on a shaft provided in said first heel clamping arm and is supported on the top surface of said first heel clamping arm, and a second elastic member which urges said second heel clamping arm toward said heel of said ski boot with respect to said first heel clamping arm, and a post fitted on the top surface of said ski and rotatably supporting said two first heel clamping units, one second heel clamping unit and said pendulum.

40. A ski binding comprising:

a pivot pin provided on a ski to be engaged with a recess provided in the sole of a ski boot, a toe clamp comprising three toe clamping arms, one of which clamps the toe of said ski boot downwardly with said ski and two of which clamp said toe of said ski boot sideways with said ski, each of said toe clamping arms having a hungover end, a post rotatably supporting said three clamping arms, said post being fitted on the top surface of said ski, three first elastic members each of which urges the corresponding one of said toe clamping arms toward said toe of said ski boot with respect to said post, and a pendulum rotatably supported by said post and having ends each of which faces the corresponding one of said hungover ends of said toe clamping arms, vertical one of said ends of said pendulum having a first recess in which a plunger is arranged on top of a second elastic member arranged at the bottom of said first recess, and a heel clamp comprising three heel clamping arms, one of which clamps the heel of said ski boot downwardly with said ski and two of which clamp said heel of said ski boot sideways with said ski, each of said heel clamping arms having a hungover end, a post rotatably supporting said three clamping arms, said post being fitted on the top surface of said ski, three first elastic members each of which urges the corresponding one of said heel clamping arms toward said heel of said ski boot with respect to said post, and a pendulum rotatably supported by said post and having ends each of which faces the corresponding one of said hungover ends of said heel clamping arms, vertical one of said ends of said pendulum having a second recess in which a plunger is arranged on top of a second elastic member arranged at the bottom of said second recess.

* * * * *